US006491309B1

(12) United States Patent
Sheldon

(10) Patent No.: US 6,491,309 B1
(45) Date of Patent: Dec. 10, 2002

(54) SUSPENSION SYSTEM FOR IN-LINE SKATES

(76) Inventor: Carroll Sheldon, 610 E. 46th St., Kearney, NE (US) 68847

( * ) Notice: Subject to any disclaimer, the term of this patent is extended or adjusted under 35 U.S.C. 154(b) by 0 days.

(21) Appl. No.: 10/175,299

(22) Filed: Jun. 19, 2002

Related U.S. Application Data

(60) Provisional application No. 60/300,885, filed on Jun. 26, 2001.

(51) Int. Cl.[7] ..... A63C 17/06

(52) U.S. Cl. ..... 280/11.27; 280/11.223; 280/11.231

(58) Field of Search ..... 280/11.221, 11.223, 280/11.224, 11.225, 11.231, 11.232, 11.27, 11.28, 87.03

(56) References Cited

U.S. PATENT DOCUMENTS 4,062,557 A * 12/1977 Roden ..... 280/11.27
4,382,605 A * 5/1983 Hegna ..... 280/11.27
5,135,244 A * 8/1992 Allison ..... 280/11.27
5,342,071 A * 8/1994 Soo ..... 280/11.27
5,390,958 A * 2/1995 Soo ..... 280/11.27
5,582,418 A * 12/1996 Closser ..... 280/11.27
5,690,344 A * 11/1997 Chen ..... 280/11.27
6,158,753 A * 12/2000 Sturbaum ..... 280/87.042
6,196,557 B1 3/2001 Gërard
6,227,550 B1 * 5/2001 Maggiolo ..... 280/11.27
6,227,551 B1 * 5/2001 Roy ..... 280/11.27
6,431,559 B1 * 8/2002 Tlucko ..... 280/11.27

* cited by examiner

*Primary Examiner*—Brian L. Johnson
*Assistant Examiner*—Jeffrey J. Restifo

(57) ABSTRACT

A suspension system includes a front walking arm assembly on a skate with front and rear wheels. The front walking arm assembly is pivotally mounted on a transverse pivot axle located between the front and rear wheels of the assembly. A standard wheel plane is formed by the axles of the front and rear wheels when the skate is traversing a planar surface, and the walking arm assembly pivot axle is located below the standard wheel plane.

17 Claims, 7 Drawing Sheets

SUSPENSION SYSTEM FOR IN-LINE SKATES

CROSS-REFERENCES TO RELATED APPLICATIONS

Priority is claimed based upon Provisional Application Serial No. 60/300,885, entitled "SUSPENSION SYSTEM FOR IN-LINE SKATES" and filed Jun. 26, 2001.

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to in-line skates, and more particularly to an improved suspension system for the wheels of in-line skates to permit movement over projections and depressions.

(2) Background Information

In-line skating has become a very popular sport and mode of travel for many people, and especially the "younger generation." While conventional roller skates and in-line skate have been known for many years, there has not been a large advancement in the features of such skates for some time.

One of the major problems encountered by the skater is the close encounter with objects in the skating path, such as sticks and stones. Even the smallest object can cause a serious problem to the skater, since the wheels on the conventional skate will not go over the object, but rather will encounter the object and stop turning. This, in turn, can result in the skater falling to the ground, especially if the contact with the object is unexpected.

BRIEF SUMMARY OF THE INVENTION

It is therefore a general object of the present invention to provide an improved suspension system for skates.

Another object of the present invention is to provide an improved suspension system for skates, which will permit the skate wheels to rise up over and obstacle, or span a depression, without causing the skate wheels to stop at the obstacle, or drop into the depression.

A further object is to provide a skate with a suspension system that is simple in operation and economical to manufacture.

These and other objects will be apparent to those skilled in the art.

The suspension system of the present invention includes a front walking arm assembly on a skate with front and rear wheels. The front walking arm assembly is pivotally mounted on a transverse pivot axle located between the front and rear wheels of the assembly. A standard wheel plane is formed by the axles of the front and rear wheels when the skate is traversing a planar surface, and the walking arm assembly pivot axle is located below the standard wheel plane.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
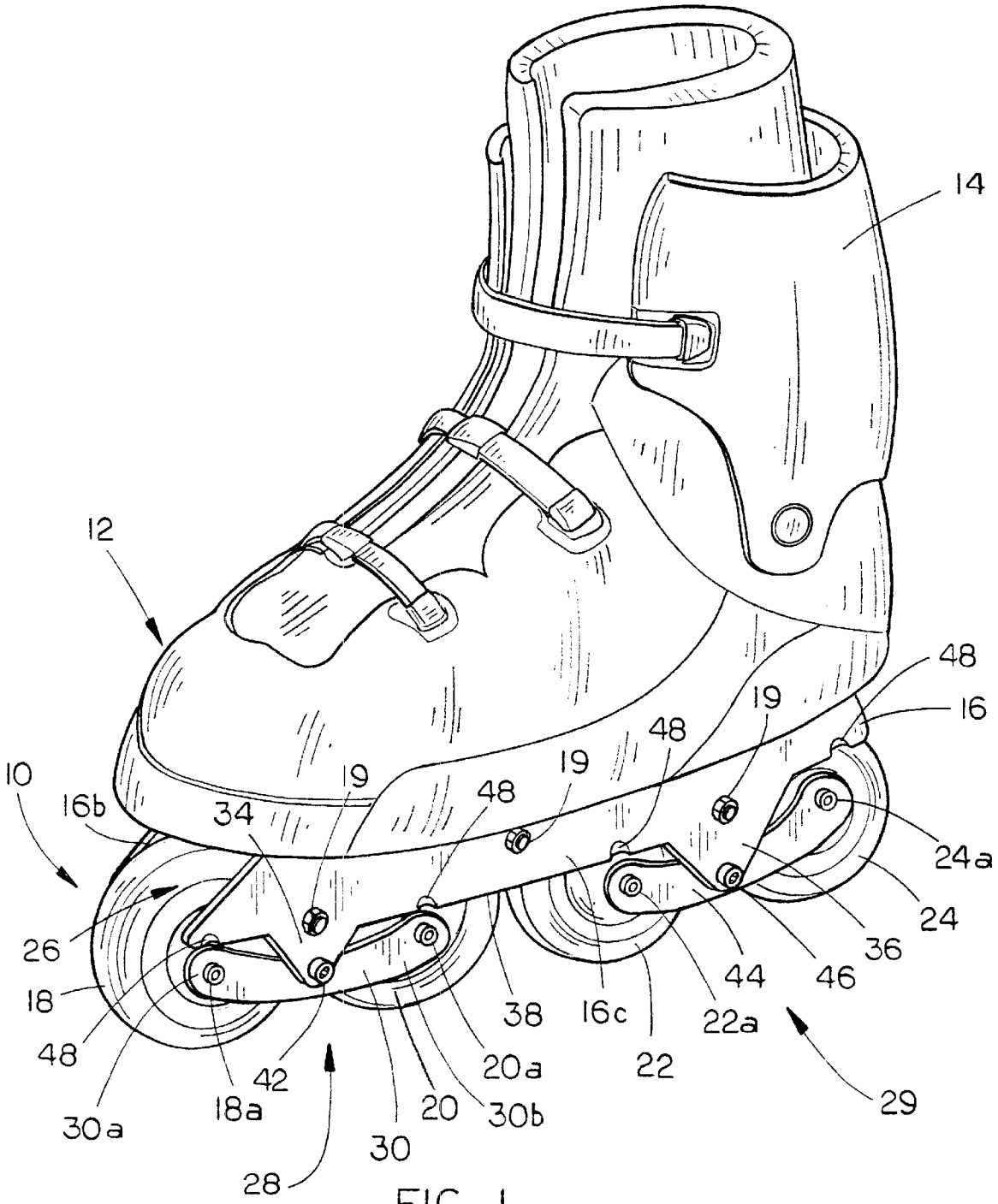
FIG. 1 is a perspective view of one of a pair of in-line skates of the present invention.

In the drawings, each part is identified with a reference numeral. The improved suspension for in-line skates of the present invention is designated generally at 10 and is shown on an in-line skate 12 of the type including a boot 14 mounted on a base frame 16. The frame 16 supports a plurality of longitudinally aligned wheels 18, 20, 22, and 24.

Figure 2:
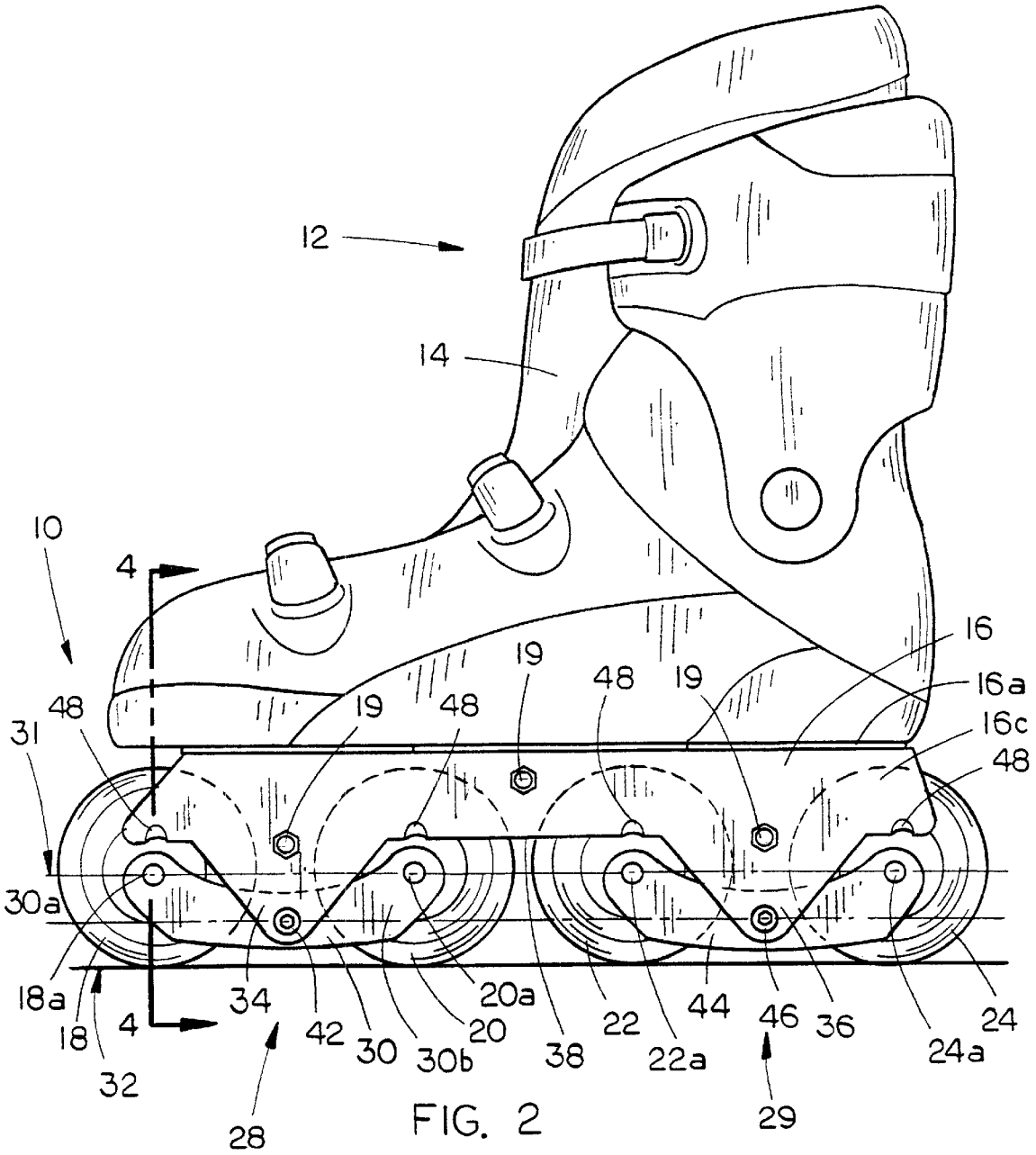
FIG. 2 is a side elevational view of the skate.

Base frame 16 is made up of a pair of rigid longitudinal members having horizontal planar flanges 16*a* (See FIG. 2) with a pair of longitudinally extending, spaced parallel legs 16*b* and 16*c*, forming an inverted channel 26. The bottom of boot 14 is fastened to the upper surface of flanges 16*a*.

Figure 3:
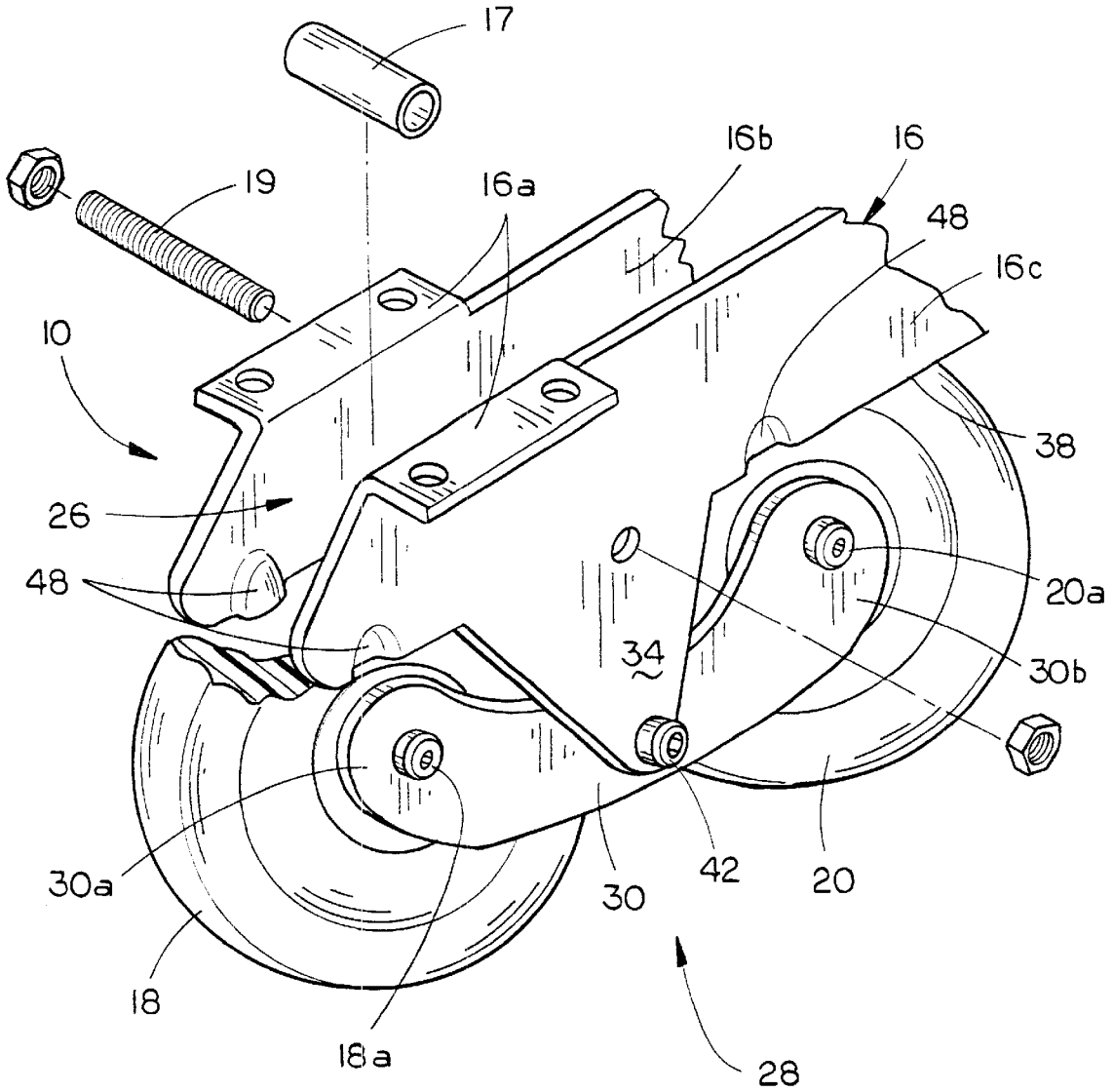
FIG. 3 is an enlarged perspective view of the front walking arm assembly of the skate.
Figure 4:
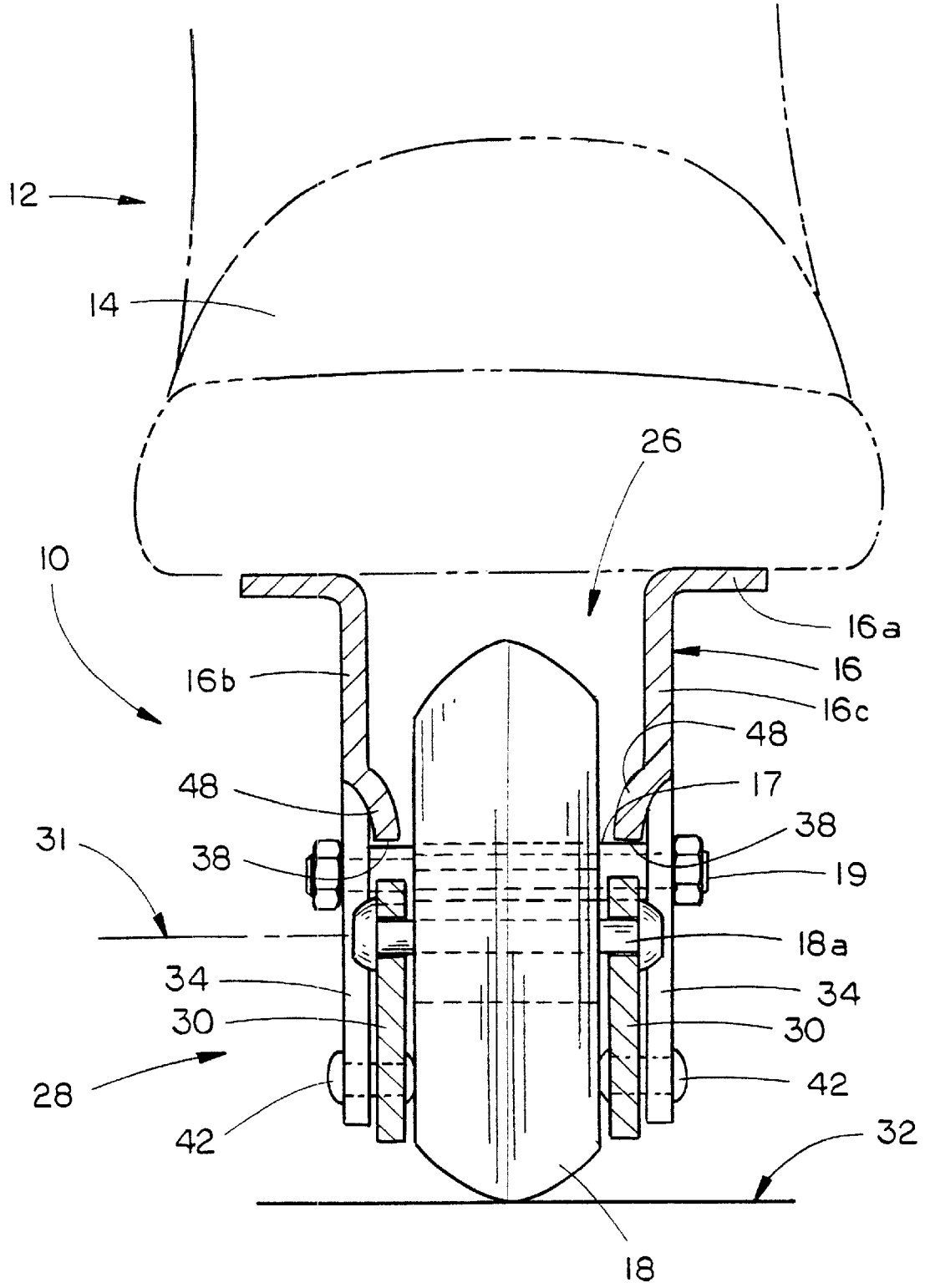
FIG. 4 is a sectional view taken at lines 4—4 in FIG. 2.

Legs 16*b* and 16*c* are maintained in parallel orientation by a series of sleeves 17 between the legs and holding them apart. Sleeves 17 are secured by bolts 19 journaled through the sleeves and retaining the legs on the ends of the sleeves (see FIGS. 2, 3 and 4).

Each wheel 18, 20, 22, and 24 is rotatably mounted on a respective axle 18*a*, 20*a*, 22*a*, and 24*a*. The wheels are longitudinally aligned within channel 26, below flanges 16*a*. The front pair of wheels 18 and 20 are mounted on a front walking arm assembly 28, while the rearward pair of wheels 22 and 24 are mounted on a rear walking arm assembly 29 as discussed in more detail hereinbelow.

Because the opposite sides of walking arms assemblies 28 and 29, as well as the opposite base frame legs 16*b* and 16*c* are identical, only one side of skate 12 and suspension 10 will be described in detail. The front walking arm assembly 28 includes a pair of vertical, longitudinally extending, parallel, spaced walking arms 30, with wheels 18 and 20 rotatably mounted therebetween. Axle 18*a* is mounted through a front end 30*a* of walking arms 30, while axle 20*a* is mounted through a rearward end 30*b* of walking arms 30. Because wheels 18, 20, 22, and 24 are preferably of the same diameter, axles 18*a*, 20*a*, 22*a* and 24*a* all lie in a single plane, hereinafter referred to as the standard wheel plane 31 (shown in FIGS. 2 and 4), when the skate is rolling across a planar skating surface 32.

Side legs 16*b* and 16*c* of base frame 16 each have a front depending projection 34 and a rear depending projection 36, oriented coplanar with legs 16*b* and 16*c* and extending below a lower edge 38 of side legs 16*b* and 16*c*. Projections 34 extend downward below the standard wheel plane 31. Front walking arms 30 are pivotally mounted between projections 34 on axle 42, for pivotal movement within a vertical plane parallel with the vertical planes of side legs 16*b* and 16*c*. Front walking arm axle 42 is preferably located midway between skating surface 32 and standard wheel plane 31 (see FIG. 2). However, the desired walking movement of walking arms about axle 42 will occur so long as axle 42 is mounted below the standard wheel plane 31.

Figure 5:
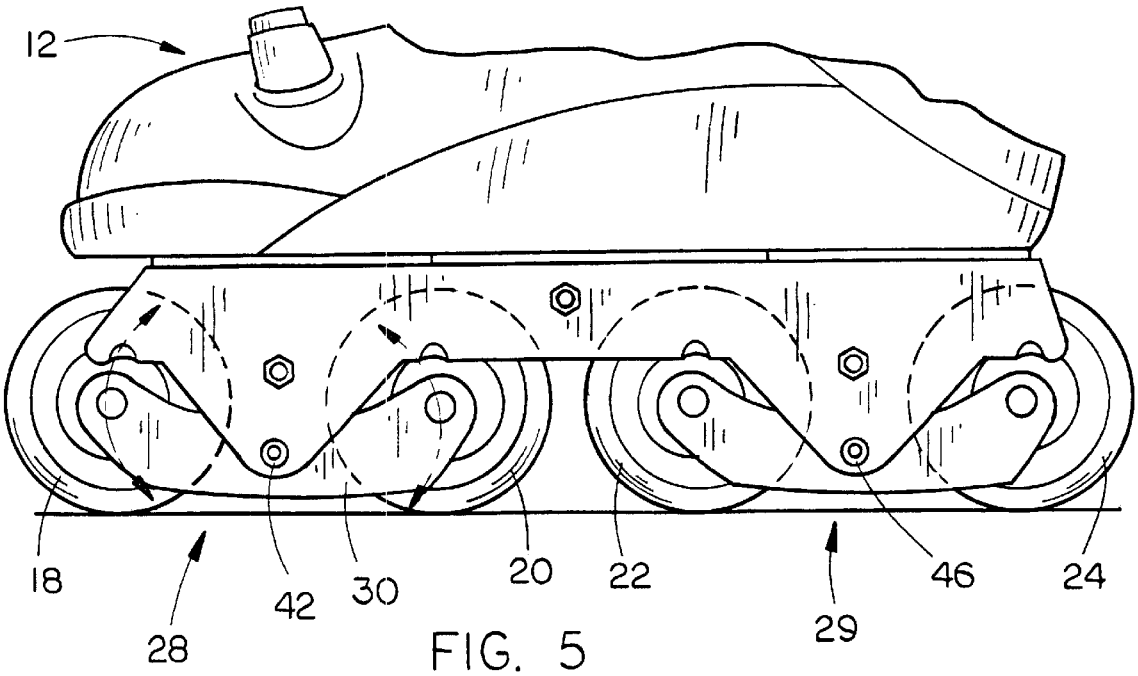
FIG. 5 is a side elevational view of the skate prior to contacting an object on the ground surface.
Figure 6:
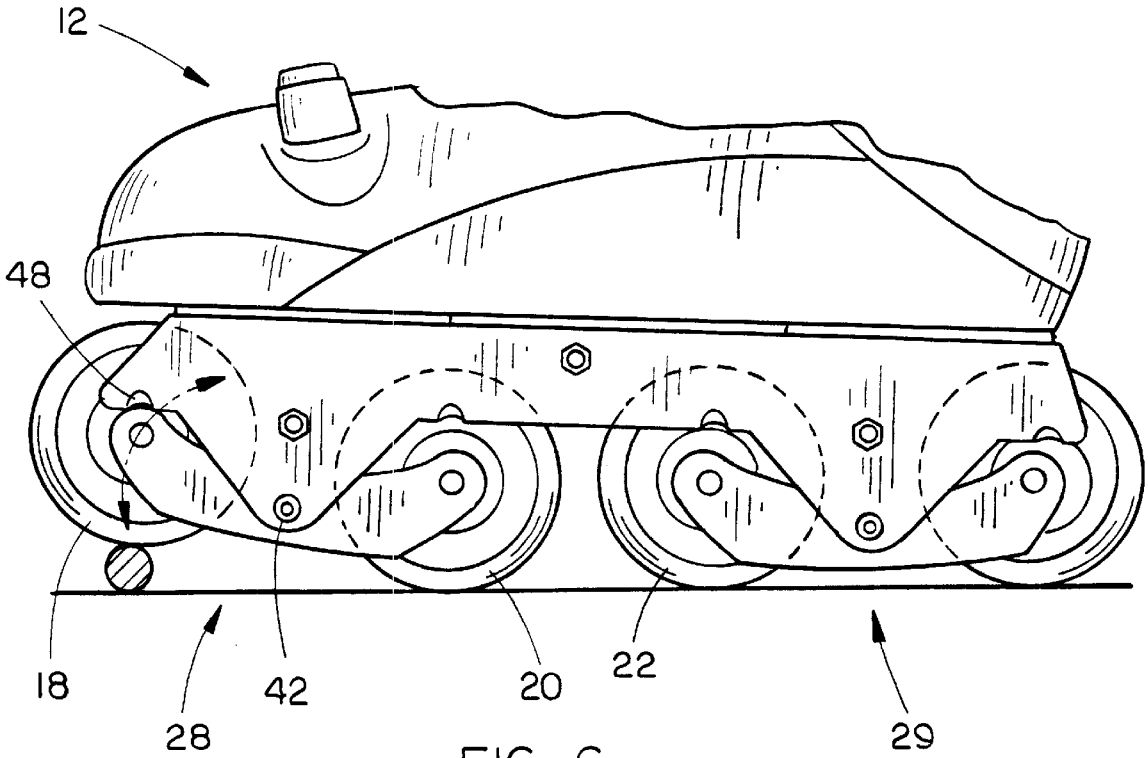
FIG. 6 is a view similar to FIG. 5, but with the front wheel of the skate rolling over an obstacle on the ground.

Referring now to FIGS. 5 and 6, the movement of the forward walking arm assembly 28 is shown in more detail. It should be noted that the movement of the forward wheel 18 of the assembly 28, as it goes over an obstacle, is subject to movement about two pivot axes: (1) the pivot axis of axle 42, as shown by arrow A, and (2) the pivoting of the entire walking arm assembly 28 about the axle 20*a* of the rear wheel 20 of assembly 28, as shown by arrows $B_1$ and $B_2$.

Because axle 42 is located below the standard wheel plane 31, it can be seen that the pivotal movement of wheel 18 about axle 42 must be upwardly and rearwardly when the wheel 18 comes into contact with an object "O" (as shown in FIG. 6). If the axle 42 was located either within the standard wheel plane 31, or above the standard wheel plane 31, the movement of front wheel 18 on front wheel axle 18*a* would be either straight upward, or upward and forward. Such forward movement of the front wheel 18 would resist the upward vertical movement of the wheel over a projection on the skating surface 32. Because the inventor has located the axle 42 below the standard wheel plane 31, this resistance is significantly reduced, allowing the front wheel to more easily move up and to the rear when traversing over an object on the skating surface.

As noted above, the wheel assembly 28 will also pivot slightly as the forward wheel 18 goes over an object "O". The walking arms 30 act as a lever to raise the forward end of skate 12 at pivot axle 42, when forward wheel 18 encounters an object "O". Because the lift point of the lever is located at axle 18*a* of wheel 18 (at the forward end of arms 30), and the fulcrum is located at the rearward end of arms 30, there is mechanical advantage applied to the skate frame at axle 42. This also means that there is only slight movement of the pivot axle 42, proportional to the greater movement of the wheel 18. This movement of axle 42 is substantially vertical through the small range of motion possible by the forward walking arm assembly 28. However, the mechanical advantage of the arrangement also assists in making the skate 12 traverse an object more easily than the prior art skates without any walking arm assemblies.

A similar arrangement of rear walking arms 44 on a rearward walking arm axle 46, with axle 46 located below the standard wheel plane 31 will permit the front wheel 22 of the rear pair 22 and 24 to more easily raise up and over a projection.

Figure 7:
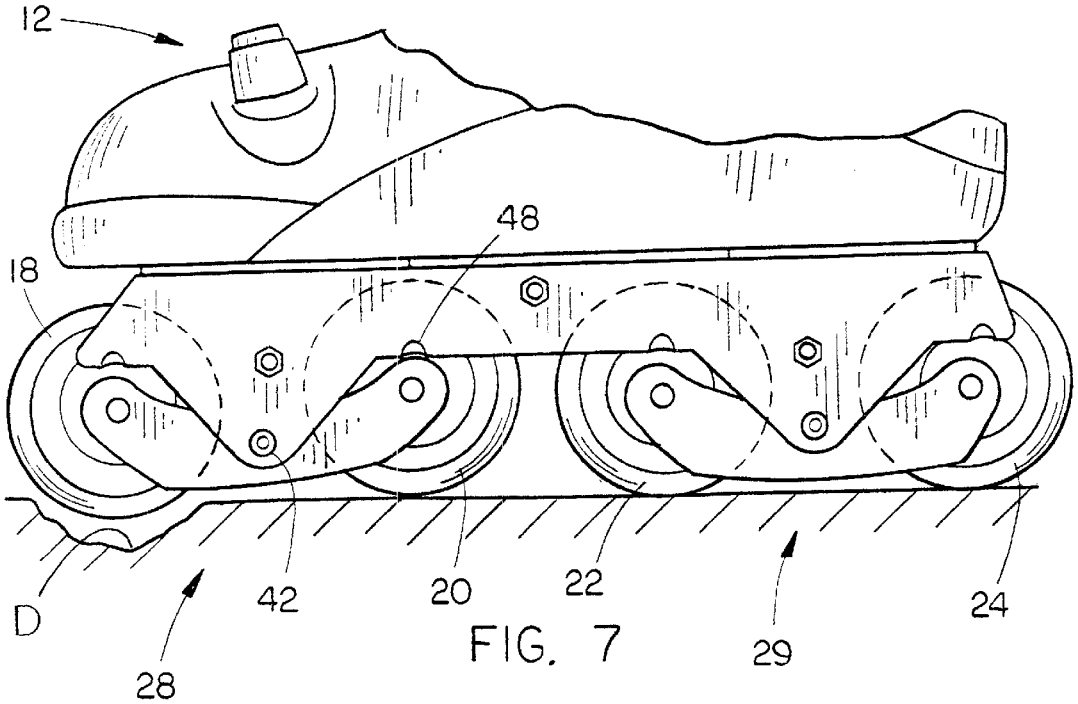
FIG. 7 is a side elevational view of the skate with the front wheel of the skate going over a depression in the ground.
Figure 8:
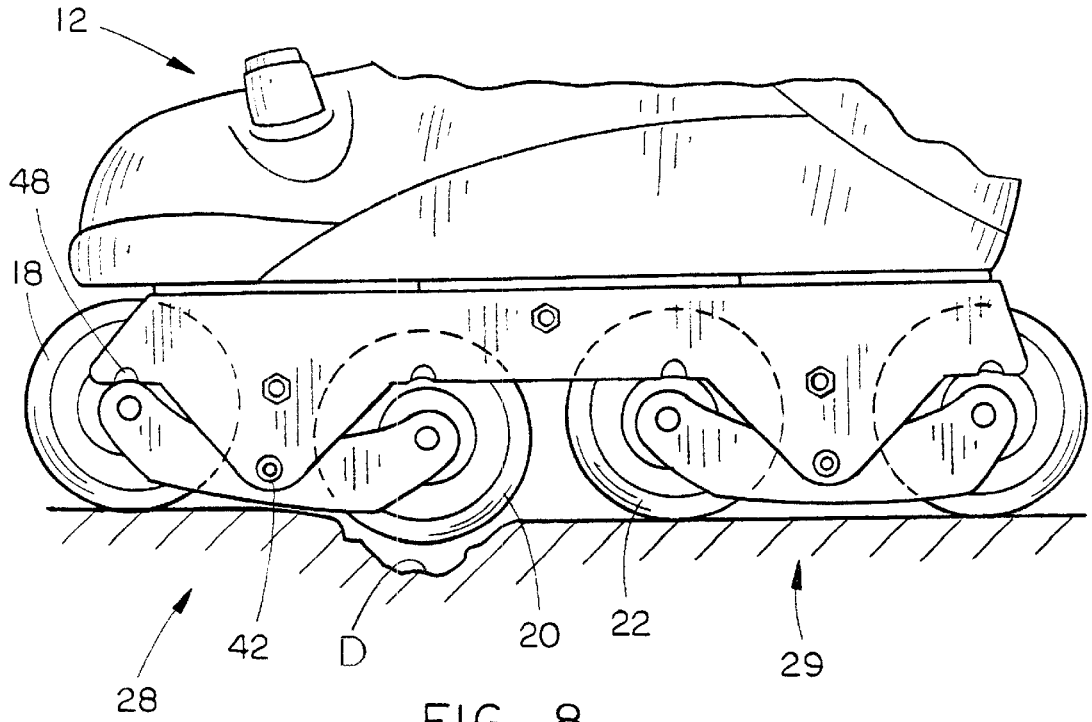
FIG. 8 is a view similar to FIG. 7, but with the second wheel of the forward walking arm assembly going over the depression.

Stops 48 are formed along the lower edge 38 of each leg 16*b* and 16*c*, and act to limit pivotal movement of walking arms 30 and 44. Preferably, the pivotable movement is less than half the radius of a wheel 18. In this way, the front wheel 18 will not drop down a distance which would allow a tangent on the wheel to contact the far edge of a crack at more than a 45° angle. This is shown in more detail in FIGS. 7 and 8, where the forward wheel assembly 28 is shown traversing a depression "D" in the skating surface.

For manufacturing purposes, stops 48 are stamped indentations formed in each leg 16*b* and 16*c*. Stops 48 project so as to limit pivotal movement of walking arms 30 and 44. Obviously, other types of stops could perform this function. For example, legs 16*b* and 16*c* could extend downward the full extent of projections 34 and 36, such that a substantially straight edge 38 is formed, rather than projecting portions. The stops 48 could still be protrusions extending inward into the path of the walking arms, or could be pins or similar protrusions mounted on the inward faces of legs 16*b* and 16*c*.

Figure 9:
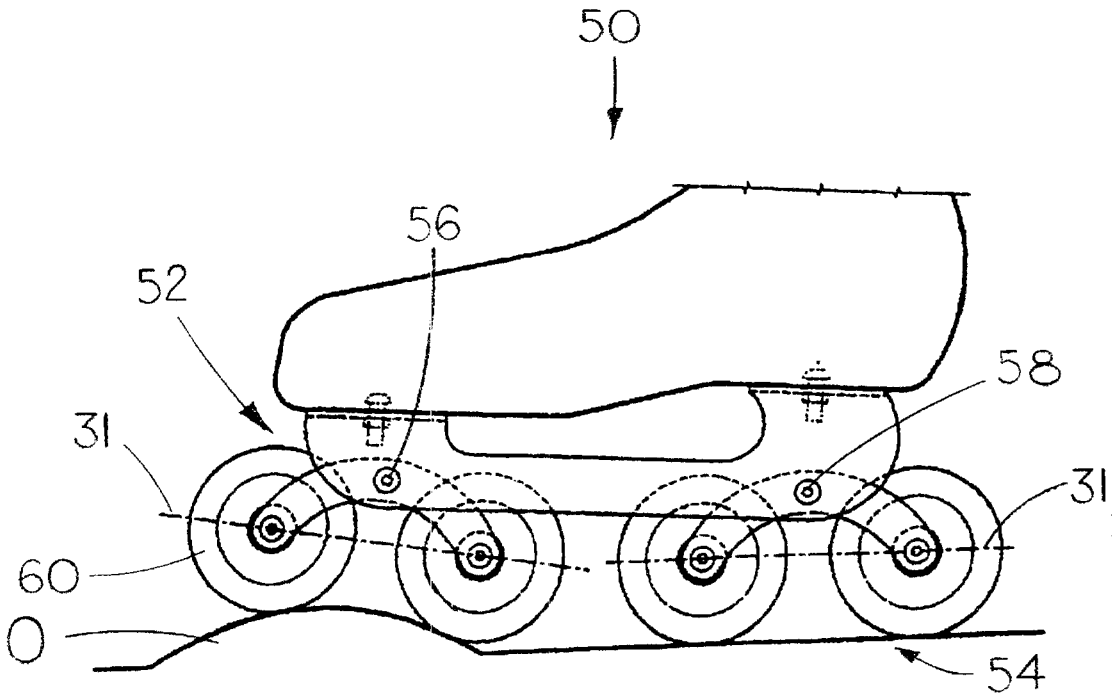
PRIOR ART FIG. 9
FIG. 9 is a side elevational view of a prior art skate.

Referring now to FIG. 9, a prior art in-line skate 50 is shown, which has forward and rearward pivoting wheel assemblies 52 and 54. While each wheel assembly 52 and 54 has a similar mechanical advantage in lifting a skate over an object "O", there is a critical difference in the location of the pivot axles 56 and 58, as compared with the suspension system 10 of the present invention. More particularly, it should be noted that the pivot axles 56 and 58 of prior art skate 50 are located above the standard wheel plane 31. This means that the pivotal movement of the forward wheels of assemblies 52 and 54 is upward and forward when the skate 50 contacts an object "O". Thus, movement of the skate upward is resisted because of the need for the wheel to pivot towards the object it is contacting.

Because the pivot axis of axle 42 of the applicant's system 10 located below the standard wheel plane 31, just the opposite occurs, as discussed above. It is this difference in pivot axle location that makes the walking assembly 28 of the present invention distinguishable from the prior art wheel assemblies shown in FIG. 9.

Whereas the invention has been shown and described in connection with the preferred embodiment thereof, many modifications, substitutions and additions may be made which are within the scope of this disclosed invention. For example, a brake could be added to the skate to provide assistance in stopping the skater. In addition, other types of accessories for the wheels and related skate features may be added or modified without departing from the spirit and scope of the invention.

I claim:

1. In an in-line skate having at least three longitudinally aligned wheels wherein each wheel has an axle, said skate further, including a boot, and base frame, and a depending front two-wheel walking arm assembly, the improvement comprising a transverse pivot axle connecting the walking arm assembly to the base frame having its pivoting axis below a standard wheel plane formed by the axles of the wheels when the wheels engage a planar skating surface, said pivot axle generally centered between the centers of the two wheels of the walking arm assembly.

2. The skate of claim 1, further comprising a stop, limiting upward movement of the rear wheel of the walking arm assembly.

3. The skate of claim 1, in which said skate includes four longitudinally aligned wheels, and having a depending rear two-wheel walking arm assembly, the rear walking arm assembly including a transverse pivot axle connecting the rearward walking arm assembly to the base frame, and having its pivoting axis below the standard wheel plane and generally centered between the two wheels of the rear walking arm assembly.

4. A skate, comprising:

a boot; having a base frame a plurality of longitudinally aligned, ground-engaging, wheels rotatably mounted on the base frame, each wheel having a transverse axle and said axles forming a standard wheel plane when the wheels engage a planar skating surface;

a first and a second of said wheels having their axles mounted on front and rear ends of a front walking arm; and the front walking arm pivotally mounted on a transverse pivot axle located below the standard wheel plane and between the first and second wheels.

5. The skate of claim 4, wherein the walking arm pivot axle is located generally midway between the first and second wheels.

6. The skate of claim 5, wherein the walking arm pivot axle is located generally midway between the standard wheel plane and the ground.

7. The skate of claim 6, further comprising:

a third and a fourth of said wheels having their axles mounted on front and rear ends of a rear walking arm; and the rear walking arm pivotally mounted on a transverse pivot axle located below the standard wheel plane and between the third and fourth wheels.

8. The skate of claim 7, wherein the rear walking arm pivot axle is located generally midway between the third and fourth wheels.

9. The skate of claim 8, wherein the rear walking arm pivot axle is located generally midway between the standard wheel plane and the ground.

10. The skate of claim 9, further comprising a first stop, limiting upward movement of the second wheel of the front walking arm assembly.

11. The skate of claim 10, further comprising a second stop, limiting upward movement of the front wheel of the front walking arm assembly.

12. The skate of claim 4, wherein the walking arm pivot axle is located generally midway between the standard wheel plane and the ground.

13. The skate of claim 4, further comprising:

a third and a fourth of said wheels having their axles mounted on front and rear ends of a rear walking arm; and the rear walking arm pivotally mounted on a transverse pivot axle located below the standard wheel plane and between the third and fourth wheels.

14. The skate of claim 13, wherein the rear walking arm pivot axle is located generally midway between the third and fourth wheels.

15. The skate of claim 13, wherein the rear walking arm pivot axle is located generally midway between the standard wheel plane and the ground.

16. The skate of claim 4, further comprising a first stop, limiting upward movement of the second wheel of the front walking arm assembly.

17. The skate of claim 16, further comprising a second stop, limiting upward movement of the front wheel of the front walking arm assembly.

* * * * *